US007730755B2

(12) United States Patent
Esaki et al.

(10) Patent No.: US 7,730,755 B2
(45) Date of Patent: Jun. 8, 2010

(54) PROCESS OF PRODUCING PERMANENT MAGNET AND PERMANENT MAGNET

(75) Inventors: Junichi Esaki, Nagoya (JP); Hiroaki Yoshida, Nagoya (JP); Sachihiro Isogawa, Nagoya (JP)

(73) Assignee: Daido Tokushuko Kabushiki Kaisha (JP)

( * ) Notice: Subject to any disclaimer, the term of this patent is extended or adjusted under 35 U.S.C. 154(b) by 483 days.

(21) Appl. No.: 11/896,360

(22) Filed: Aug. 31, 2007

(65) Prior Publication Data

US 2008/0055031 A1 Mar. 6, 2008

(30) Foreign Application Priority Data

Sep. 6, 2006 (JP) ..... 2006-242146
Jul. 4, 2007 (JP) ..... 2007-176579

(51) Int. Cl.
*B21D 22/00* (2006.01)
*B21D 31/00* (2006.01)
*H01F 5/00* (2006.01)
*B21C 23/00* (2006.01)

(52) U.S. Cl. ..... 72/343; 72/253.1; 72/467; 72/700; 148/101; 148/104; 419/12; 264/112

(58) Field of Classification Search ..... 72/253.1, 72/264, 265, 343, 364, 467, 700; 148/101, 148/104, 105, 120; 419/12, 35; 264/112, 264/119

See application file for complete search history.

(56) References Cited

U.S. PATENT DOCUMENTS 4,051,706 A * 10/1977 Sakamoto et al. ..... 72/253.1
4,623,404 A * 11/1986 Ibata et al. ..... 148/101
4,648,915 A * 3/1987 Ibata et al. ..... 148/101
4,653,305 A * 3/1987 Kanamaru et al. ..... 72/343
4,892,596 A * 1/1990 Chatterjee ..... 148/104
4,915,891 A * 4/1990 Chandhok et al. ..... 264/112
4,960,469 A * 10/1990 Tanigawa et al. ..... 148/105
4,985,085 A * 1/1991 Chatterjee ..... 72/253.1
5,000,796 A * 3/1991 Chatterjee ..... 72/700
5,289,152 A * 2/1994 Oguriyama et al. ..... 335/302
6,639,500 B2 * 10/2003 Makino et al. ..... 336/200
7,325,434 B2 * 2/2008 Esaki et al. ..... 72/467

FOREIGN PATENT DOCUMENTS

JP 09-129463 5/1997

* cited by examiner

*Primary Examiner*—David B Jones
(74) *Attorney, Agent, or Firm*—Bacon & Thomas, PLLC

(57) ABSTRACT

The present invention relates to a process of producing a permanent magnet, which includes extruding a preform to form a plate-shaped permanent magnet, in which the preform is extruded in such a way that a dimension of a cross section of the preform is reduced in an X-direction and enlarged in a Y-direction perpendicular to the X-direction. The present invention also relates to a plate-shaped permanent magnet formed by extruding a preform, in which the preform is extruded in such a way that a dimension of a cross section of the preform is reduced in an X-direction and enlarged in a Y-direction perpendicular to the X-direction, whereby the permanent magnet has a strain ratio $\epsilon_2/\epsilon_1$ with respect to the preform in a range of 0.2 to 3.5, in which $\epsilon_1$ is a strain in the direction of the extrusion of the preform and $\epsilon_2$ is a strain in the Y-direction.

5 Claims, 9 Drawing Sheets

PROCESS OF PRODUCING PERMANENT MAGNET AND PERMANENT MAGNET

FIELD OF THE INVENTION

The present invention relates to a process of producing a permanent magnet having excellent magnetic properties by extrusion molding.

BACKGROUND OF THE INVENTION

Permanent magnets constituted of a rare earth element, a metal of the iron group and boron in the shape of a plate, such as plane, arcuate, semi-circular or crescent, and having magnetic anisotropy imparted by hot (or warm) plastic working have been industrially and domestically used. These permanent magnets are manufactured as will now be described below.

A raw material prepared by mixing a rare earth, a metal of the iron group and boron is melted and the molten magnet alloy thus obtained is jetted out onto a rotating roll of e.g. copper to form thereon a rapid-quenched flaky ribbon composed of nano-sized crystal grains. The magnet alloy powder obtained by rapid-quenching as described above is crushed into an appropriate particle diameter and cold pressed into a compact. The compact is hot or warm pressed into a body having higher density, and is then subjected to hot or warm plastic working to form a plate sized as desired and having magnetic anisotropy. Examples of the method for plastic working to impart magnetic anisotropy to the plate include (1) upsetting, (2) extrusion and (3) rolling. The magnet material subjected to plastic working is magnetized in the later step, whereby a practically useful permanent magnet having magnetic anisotropy is provided.

JP-A-9-129463, for example, generally describes the manufacture of a ring-shaped permanent magnet and the like by extrusion.

SUMMARY OF THE INVENTION

Upsetting (1) can realize high magnetic properties, but is inferior to both extrusion (2) and rolling (3) in productivity, material yield, acceptable product ratio, and cost of manufacture. On the other hand, although both extrusion (2) and rolling (3) are superior in productivity, material yield, acceptable product ratio, and cost of manufacture, they have the drawback of being unable to realize high magnetic properties. In addition, extrusion (2) is excellent in material yield and acceptable product ratio in comparison with rolling (3). While each method has its own characteristics as described above, there is an industrial demand for the manufacture of a plate-shaped permanent magnet by extrusion, since extrusion (2) is excellent in a good balance between material yield, acceptable product ratio and productivity.

The disclosure of JP-A-9-129463 relates to the manufacture of a ring-shaped permanent magnet and the manufacture of any permanent magnet in the shape of a plate, such as plane, arcuate, semi-circular or crescent is not considered. Therefore, there is a demand for a method which can manufacture a plate-shaped permanent magnet having improved magnetic properties by extrusion.

In view of the problems in the conventional art as pointed out above, it is an object of the present invention to provide a process capable of producing a permanent magnet having high magnetic properties by extrusion, which is superior in terms of material yield and acceptable product ratio; and a permanent magnet produced by extrusion.

DESCRIPTION OF THE REFERENCE NUMERALS

18: Preform
20: permanent magnet

DETAILED DESCRIPTION OF THE INVENTION

Namely, the present invention relates to the following (1).

(1) A process of producing a permanent magnet, which comprises extruding a preform to form a plate-shaped permanent magnet, wherein the preform is extruded in such a way that a dimension of a cross section of the preform is reduced in an X-direction and enlarged in a Y-direction perpendicular to the X-direction.

According to the process of (1) above, by extruding the preform in such a way that the dimension of the cross section of the preform is reduced in an X-direction and enlarged in a Y-direction perpendicular to the X-direction, a permanent magnet having magnetic properties equal to or higher than those of the permanent magnet produced by upsetting can be produced.

Furthermore, the present invention relates to the following (2).

(2) A plate-shaped permanent magnet formed by extruding a preform, wherein the preform is extruded in such a way that a dimension of a cross section of the preform is reduced in an X-direction and enlarged in a Y-direction perpendicular to the X-direction, whereby said permanent magnet has a strain ratio $\epsilon_2/\epsilon_1$ with respect to the preform in a range of 0.2 to 3.5, wherein $\epsilon_1$ is a strain in the direction of extrusion of the preform and $\epsilon_2$ is a strain in the Y-direction.

The permanent magnet of (2) above is subjected to a plastic working to have a strain ratio with respect to the preform in the range of 0.2 to 3.5, whereby the permanent magnet has magnetic properties equal to or higher than those of the permanent magnet produced by upsetting.

According to the production process of the present invention, a permanent magnet having high magnetic properties can be produced at low cost.

Furthermore, the permanent magnet of the present invention is excellent in magnetic properties.

The process of producing a permanent magnet and the permanent magnet according to the present invention will now be described by way of preferred embodiments thereof with reference to the accompanying drawings.

Embodiment 1

Figure 1:
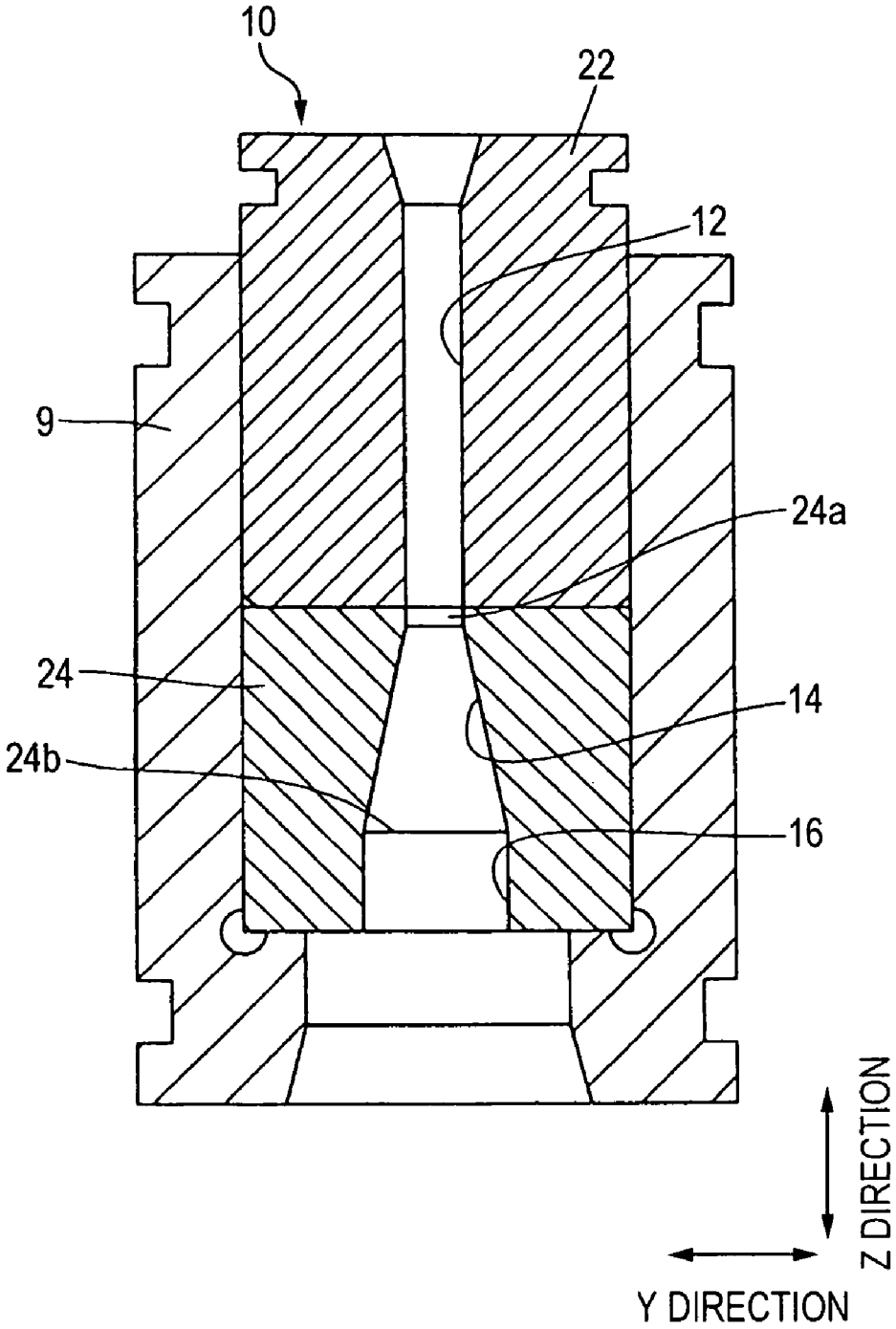
FIG. 1 is a longitudinally sectional and front elevational view of an extrusion die according to Embodiment 1.
Figure 2:
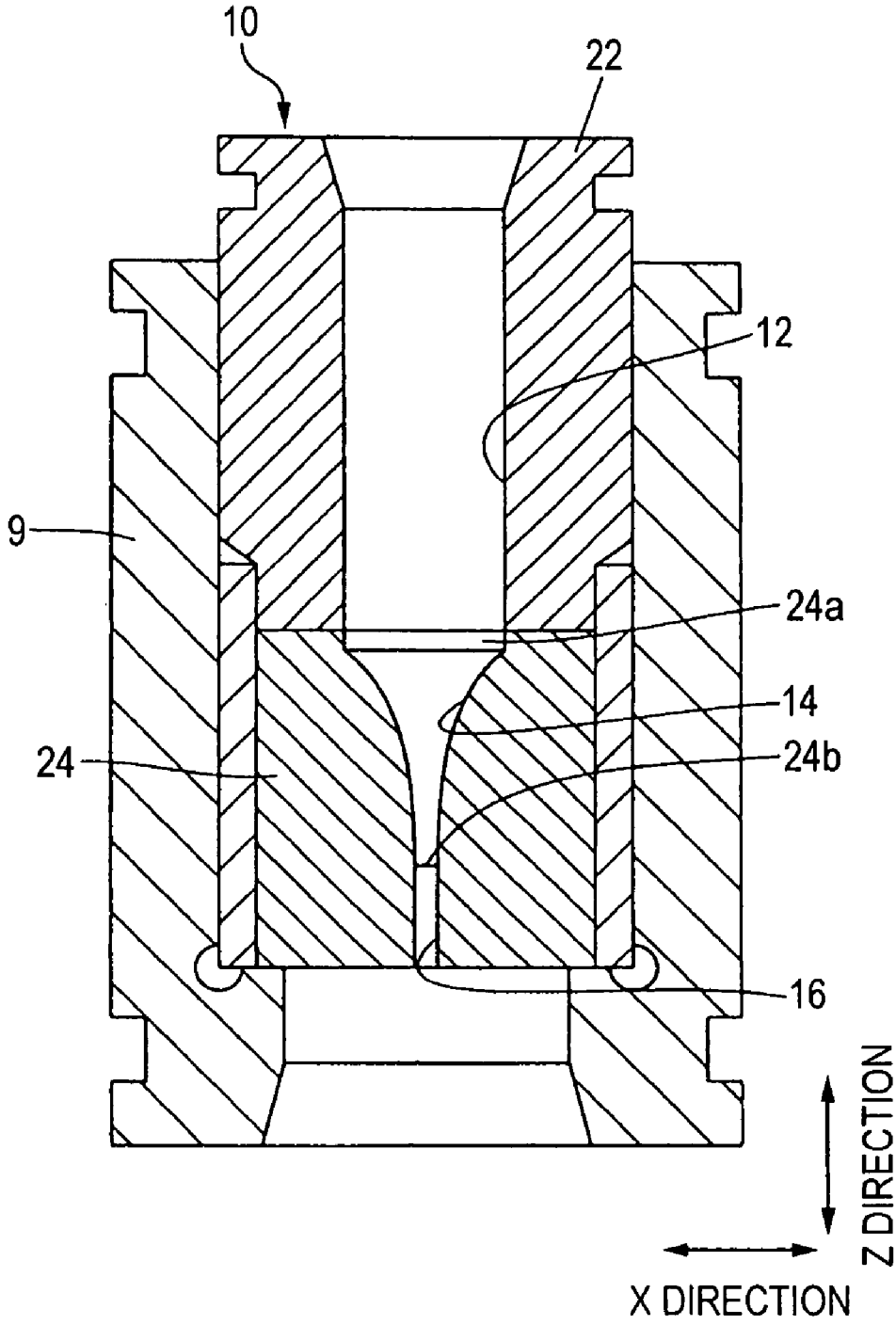
FIG. 2 is a longitudinally sectional and side elevational view of the extrusion die according to Embodiment 1.
Figure 8A:
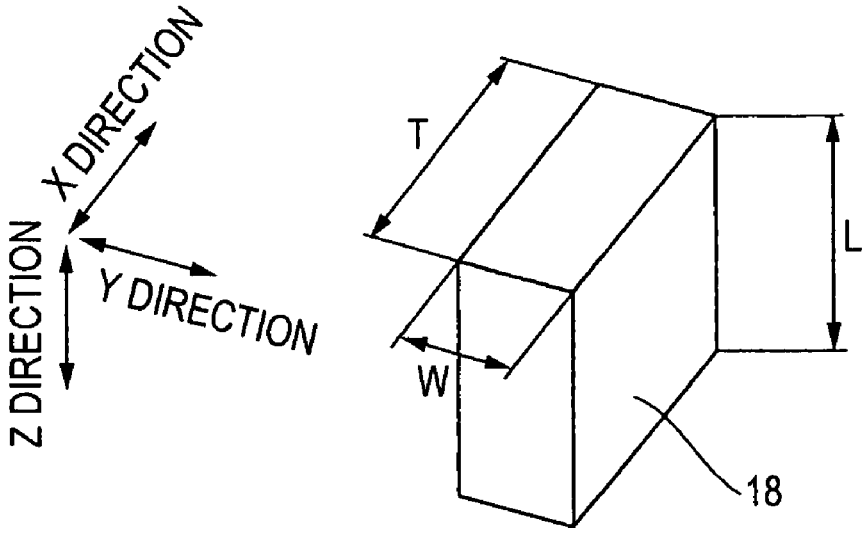
FIG. 8A is a schematic illustration of a preform according to Embodiment 1.

FIGS. 1 and 2 respectively show a preferred form of an extrusion die used in the process of producing a permanent magnet. The extrusion die 10 mounted in a die holder 9 has a through hole 12, a tapered hole 14 and a uniformly sized hole 16 formed in series to one another therein. A preform 18 placed in the through hole 12 is pressed by a press punch (not shown in Figs) and extruded through the tapered hole 14 and uniformly sized hole 16 to form a plate-shaped permanent magnet (magnet blank) 20. The preform 18 is formed by melting a raw material prepared by mixing a rare earth, a metal of the iron group and boron; jetting out the molten material onto a rotating roll to form thereon a rapid-quenched flaky ribbon; crushing the magnet alloy powder thus obtained to have an appropriate particle diameter; cold pressing it into a compact and hot or warm pressing the compact into a body having higher density. The preform 18 may have a thickness T, a width W and a length L and may be oblong in cross section (i.e. in its section perpendicular to its length), as shown in FIG. 8A. While the rare earth may be selected from Y and the lanthanoids, it is preferable to use Nd, Pr, Dy, Tb or a mixture of two or more thereof. While the metal of the iron group may be selected from Fe, Co and Ni, it is preferable to use Fe, Co or a mixture thereof. Ga may be optionally added to achieve an improved plastic workability (or cracking resistance).

Figure 8B:
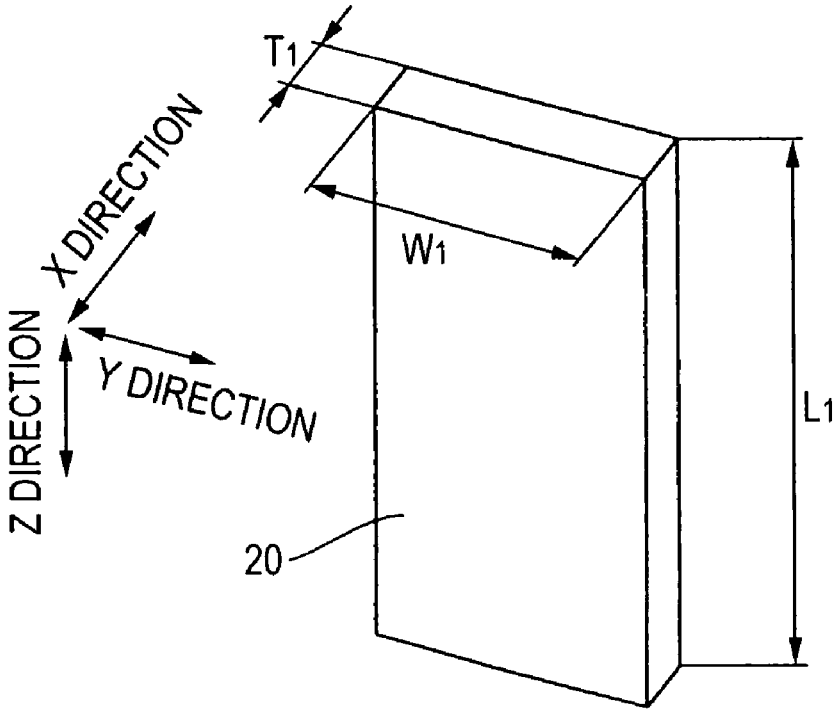
FIG. 8B is a schematic illustration of a permanent magnet formed from the preform shown in FIG. 8A.

The extrusion die 10 is designed for forming a plate-shaped permanent magnet 20 having a rectangular cross section in which a width $W_1$ (as measured in the Y-direction) is larger than a thickness $T_1$ (as measured in the X-direction) as shown in FIG. 8B, from a preform 18 having an oblong cross section perpendicular to the direction of the extrusion (extrusion cross section) as shown in FIG. 8A. Namely, the extrusion die 10 is constituted of an entry-side die 22 in which the through hole 12 having a certain length extending along the direction of extrusion is formed, and a forming die 24 which is disposed at the outlet of the entry-side die 22 and has the tapered hole 14 communicating with the through hole 12. Further, the uniformly sized through hole 16 communicating with the tapered hole 14 is formed at the outlet of the forming die 24.

Figure 3:
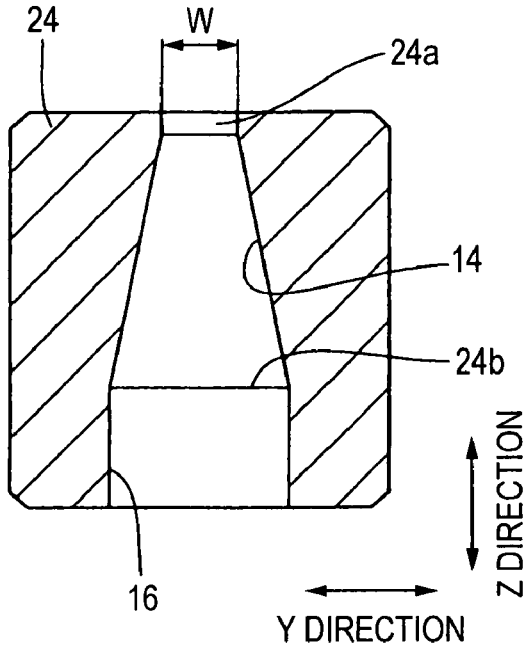
FIG. 3 is an enlarged longitudinally sectional and front elevational view of the forming die according to Embodiment 1.
Figure 4:
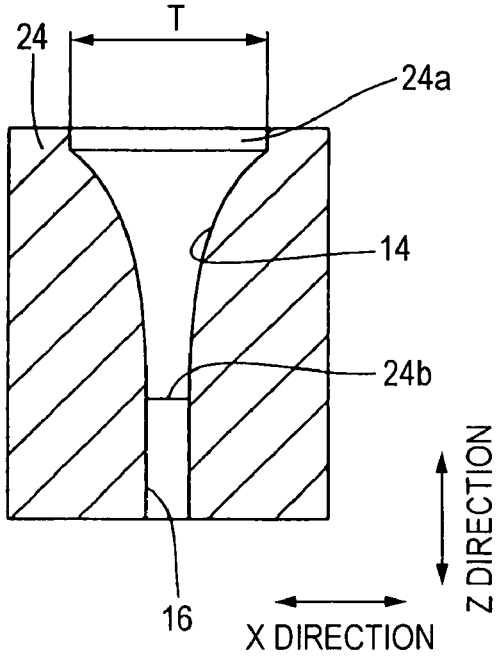
FIG. 4 is an enlarged longitudinally sectional and side elevational view of the forming die according to Embodiment 1.
Figure 5:
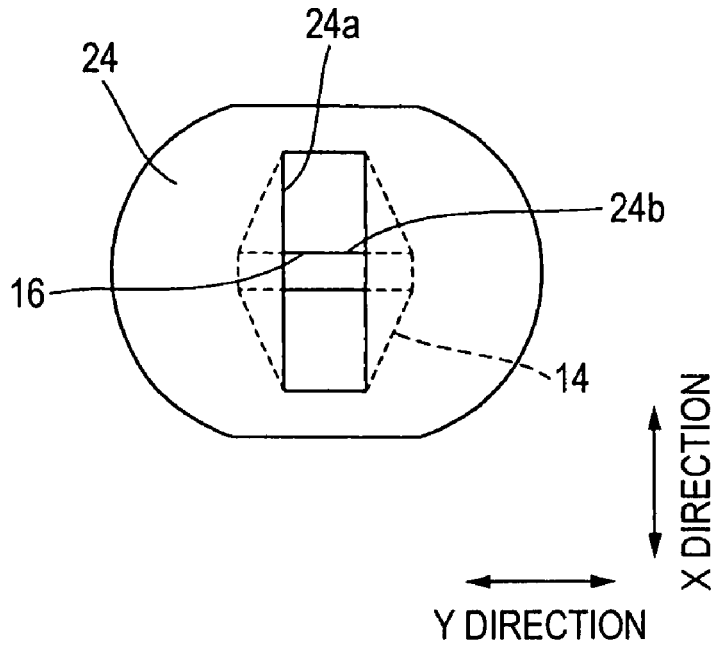
FIG. 5 is a top plan view of the forming die according to Embodiment 1.
Figure 6:
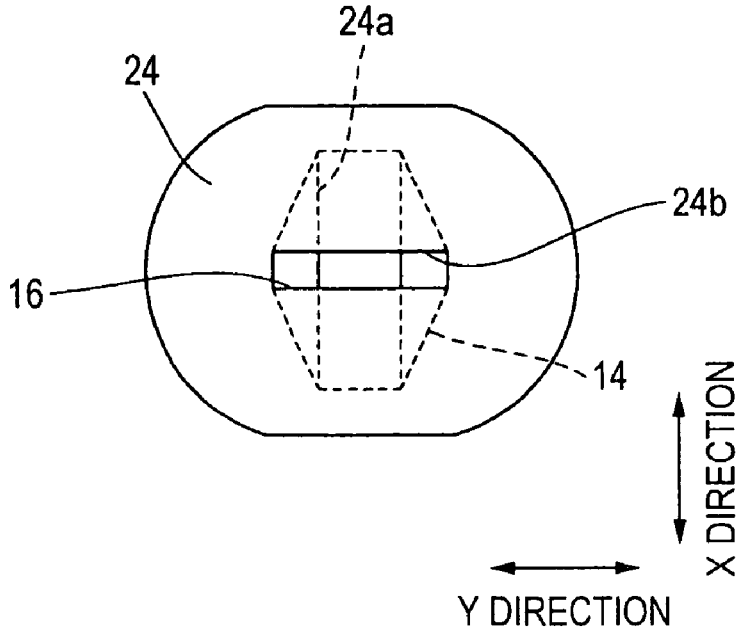
FIG. 6 is a bottom plan view of the forming die according to Embodiment 1.
Figure 7:
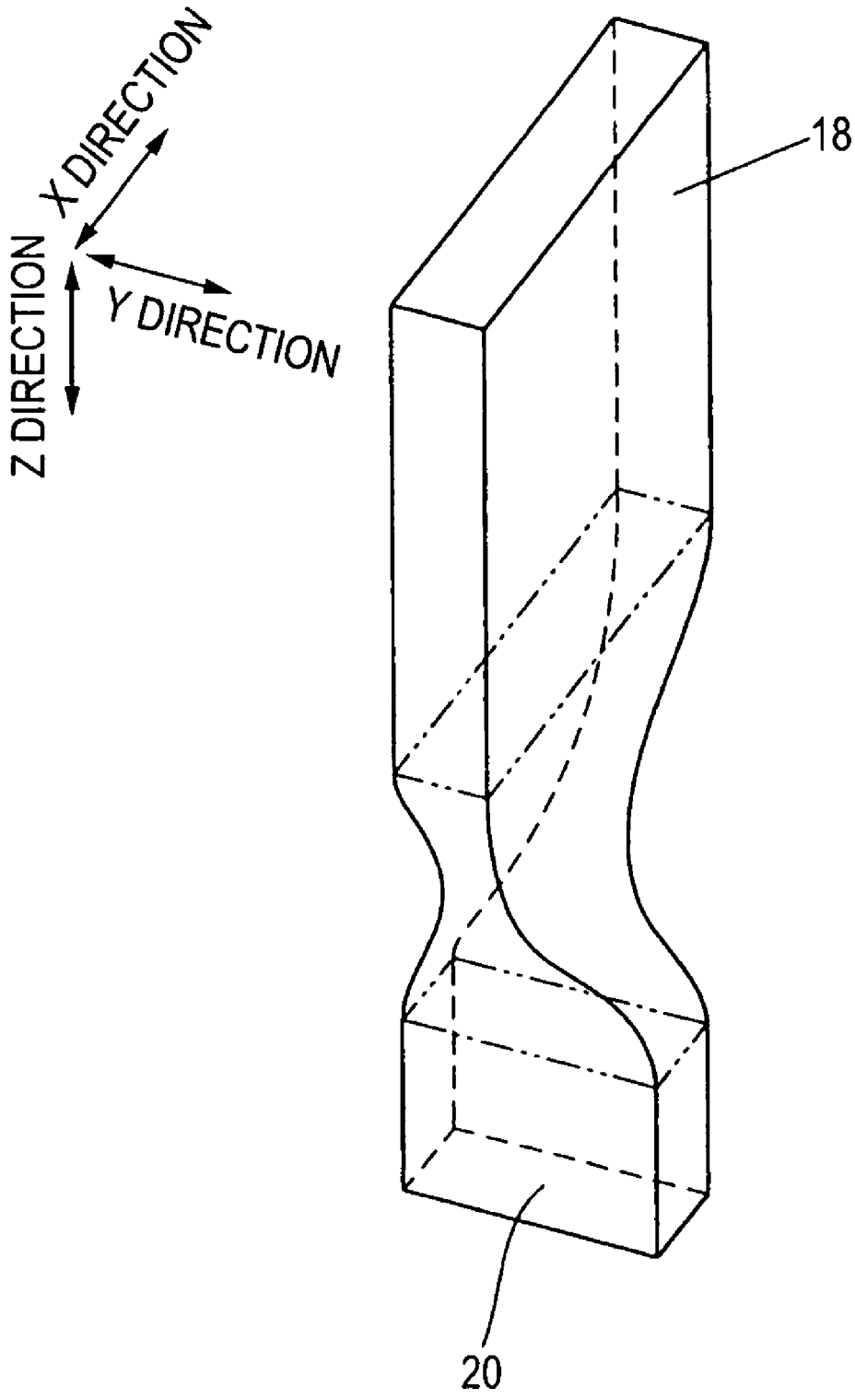
FIG. 7 is a diagram illustrating the plastic working of a preform extruded from the extrusion die according to Embodiment 1 to form a permanent magnet.

The through hole 12 formed in the entry-side die 22 has such an oblong cross section that the dimensions thereof in the X-direction in its cross section perpendicular to the direction of extrusion and in the Y-direction perpendicular to the X-direction may be substantially identical to the thickness T and width W of the preform 18, respectively. The preform 18 is mounted in the through hole 12 along a length direction (Z-direction which is perpendicular to the X- and Y-directions) under the conditions with a thickness and width directions being positioned in the X- and Y-directions, respectively. The uniformly sized through hole 16 formed at the outlet of the forming die 24 has such a rectangular cross section that the dimensions thereof in the X-direction in its cross section perpendicular to the direction of extrusion and in the Y-direction perpendicular to the X-direction may be respectively identical to the thickness $T_1$ and width $W_1$ of the permanent magnet 20 to be manufactured in its cross section perpendicular to the direction of extrusion (extrusion cross section), as shown in FIG. 8B. The tapered hole 14 formed in the forming die 24 has at its inlet 24*a* such a rectangular cross section that the dimensions T and W in the X- and Y-directions may be respectively identical to the corresponding dimensions of the through hole 12, while at its outlet 24b, the tapered hole 14 has such a rectangular cross section that the dimensions $T_1$ and $W_1$ in the X- and Y-directions may be respectively identical to the corresponding dimensions of the uniformly sized through hole 16, as shown in FIGS. 3 to 6. The tapered hole 14 is tapered so that from its inlet 24*a* to its outlet 24*b*, the dimensions thereof may be reduced in the X-direction as shown in FIG. 4, and enlarged in the Y-direction as shown in FIG. 3. Namely, the preform 18 having an oblong cross section is extruded using the extrusion die 10 in such a way that the dimension of the cross section thereof is reduced in the X-direction and enlarged in the Y-direction, thereby to form a plate-shaped permanent magnet 20 having a rectangular cross section, as shown in FIG. 7. In other words, the X-direction is the direction in which the preform 18 is reduced in dimension by extrusion, while the Y-direction is the direction in which the preform is enlarged in dimension by extrusion. In this case, the permanent magnet 20 has magnetic anisotropy in the X-direction which is the direction of the maximum compression.

The tapered hole 14 is formed to have a smoothly curved surface contour to realize the smooth plastic working of the preform 18. Additionally, in this embodiment, the inlet 24*a* of the forming die 24 is formed to have the same dimensions as those of the corresponding through hole 12 and be successively present with a predetermined length in the axial direction, and the connected part of the inlet 24*a* and the tapered surface is formed to have a curved surface having an appropriate radius of curvature, in order to realize the smooth plastic working of the preform 18. The outlet 24*b* of the tapered hole 14 is also smoothly continuous to the uniformly sized through hole 16 in order to realize the smooth plastic working of the preform 18.

The respective dimensions of the preform 18 and the through hole 12, tapered hole 14 and uniformly sized through hole 16 of the extrusion die 10 in the X-, Y- and Z-directions are controlled so that the permanent magnet 20 produced by extrusion of the preform 18 have a strain ratio $\epsilon_2/\epsilon_1$ in the range of from 0.2 to 3.5, preferably from 0.4 to 1.6, in which $\epsilon_1$ is a strain of the permanent magnet 20 in the direction of the extrusion of the preform 18 and $\epsilon_2$ is a strain in the Y-direction. Namely, when the plate-shaped permanent magnet 20 having the thickness $T_1$, width $W_1$ and length $L_1$ is formed from the preform 18 having an oblong cross section and having the thickness T, width W and length L as in embodiment 1, the respective dimensions of the preform 18 and the through hole 12, tapered hole 14 and uniformly sized through hole 16 in the X-, Y- and Z-directions are controlled so that the relationship as represented by the following formula (1) is satisfied.

$$\epsilon_2/\epsilon_1=\ln(W_1/W)/\ln(L_1/L)=0.2 \text{ to } 3.5 \quad (1)$$

(In the formula (1), ln stands for logarithm natural.)

When the strain ratio $\epsilon_2/\epsilon_1$ is within the range defined by the formula (1) above, the permanent magnet 20 produced by extrusion becomes equal to or even superior to the permanent magnet produced by upsetting in terms of magnetic properties such as the residual magnetic flux density (Br), intrinsic coercive force (iHc) and maximum energy product ((BH) max). When the strain ratio $\epsilon_2/\epsilon_1$ is within the range of 0.4 to 1.6, the permanent magnet 20 is further improved in magnetic properties. Namely, when the strain $\epsilon_1$ imparted to the permanent magnet 20 by plastic working is closer to the strain $\epsilon_2$ in the Y-direction, the permanent magnet has a higher degree of magnetic anisotropy in the X-direction and better magnetic properties. Accordingly, the magnetic properties becomes highest when the strain ratio $\epsilon_2/\epsilon_1$ is 1. In the case that the strain ratio $\epsilon_2/\epsilon_1$ fails to fall within the range defined above, the magnet has only a low degree of magnetic anisotropy in the X-direction and fails to exhibit high magnetic properties.

EXPERIMENT 1

A magnetic alloy containing 29.5% by mass of Nd, 5% by mass of Co, 0.9% by mass of B and 0.6% by mass of Ga, with the balance of being substantially Fe, was produced by melting and cooled rapidly by a single-roll method to produce a magnetic alloy strip having a thickness of 25 μm and an average crystal grain diameter of 0.1 μm or less. The strip was then crushed to prepare a magnetic powder having a particle length of 200 μm or less. The powder was cold compacted and the resultant compact was hot pressed at a temperature of 800° C. and a pressure of 200 MPa in an argon gas atmosphere to produce a preform 18 having a rectangular cross section with a thickness T of 36 mm, a width W of 19 mm and a length L of 25 mm. The preform 18 had an average crystal grain diameter of 0.1 μm. The ration of bulk density of the preform 18 to the real density ratio of the magnetic powder was 0.999. Experiment 1 was conducted to alter the strain ratio $\epsilon_2/\epsilon_1$ permanent magnet 20 produced by extruding the preform 18 having a fixed shape and thereby verify the effect of the strain ratio $\epsilon_2/\epsilon_1$.

Each preform 18 was extruded with an extrusion die 10 having a through hole 12, a tapered hole 14 and a uniformly sized through hole 16 designed to produce a permanent magnet 20 having a thickness $T_1$ of 8 mm as extruded and having a strain ratio $\epsilon_2/\epsilon_1$ of 0.1 according to Comparative Example 1, a strain ratio $\epsilon_2/\epsilon_1$ of 0.2 according to Example 1 of the invention, a strain ratio $\epsilon_2/\epsilon_1$ of 0.4 according to Example 2 of the invention, a strain ratio $\epsilon_2/\epsilon_1$ of 0.8 according to Example 3 of the invention, a strain ratio $\epsilon_2/\epsilon_1$ of 1.0 according to Example 4 of the invention, a strain ratio $\epsilon_2/\epsilon_{1\ l\ of}$ 1.6 according to Example 5 of the invention, a strain ratio $\epsilon_2/\epsilon_1$ of 2.0 according to Example 6 of the invention, a strain ratio $\epsilon_2/\epsilon_1$ of 3.5 according to Example 7 of the invention, or a strain ratio $\epsilon_2/\epsilon_1$ of 4.0 according to Comparative Example 2. The permanent magnets were respectively magnetized under the same conditions and were each examined for the residual magnetic flux density (Br), intrinsic coercive force (iHc) and maximum energy product ((BH)max) in the X-direction. The results are shown in Table 1. Table 2 shows the dimensions of the preforms 18 and the permanent magnets 20 according to Examples 1 to 7 of the invention and Comparative Examples 1 and 2.

When each preform 18 was extruded, the preform and the extrusion die 10 had a temperature of 800° C. and the preform was extruded by employing an 80-ton hydraulic press. Referring more specifically to the examination of the magnetic properties of each of the permanent magnets 20 according to Examples 1 to 7 of the invention and Comparative Examples 1 and 2, a magnetic test specimen having a width of 8 mm, a length of 8 mm and a thickness of 8 mm was taken from the widthwise and lengthwise central portion of each magnet and magnetized in a magnetic field of 3.2 MA/m. Each test specimen brought to saturation magnetization was examined for the magnetic properties by a BH tracer. According to the measurement on the test specimen according to Example 4 of the invention, the crystal grains had a flat shape with the size of 0.1 μm on the average in the X-direction and 0.5 μm on the average in the Y-direction.

In Table 1, the magnetic properties of the permanent magnets 20 made as examples for reference by upsetting, rolling and forward extrusion and having the same maximum compression strain as that of the magnets according to Examples 1 to 7 of the invention (i.e. strain across their thickness) are also shown. The followings describe the conditions under which the magnets according to the examples for reference were produced and examined for their magnetic properties.

Referring to upsetting, a solid cylindrical preform 18 having a diameter D of 25 mm and a thickness T of 36 mm was compressed between two vertically spaced apart flat dies to form a permanent magnet 20 having a thickness $T_1$ of 8 mm. When the preform 18 was subjected to upsetting, the preform and the two flat dies had a temperature of 800° C. and a 200-ton hydraulic press was employed. The permanent magnet 20 had a diameter $D_1$ of 53 mm. However, since cracking in the free surface not contacting the dies was large, only about 50% of the entire permanent magnet was found to be sound. Accordingly, a magnetic test specimen having a width of 8 mm, a length of 8 mm and a thickness of 8 mm was taken from a sound central portion, magnetized in a magnetic field of 3.2 MA/m and examined for the magnetic properties by a BH tracer. The magnetic properties shown in Table 1 for the product produced by upsetting are those which were determined in the direction of the thickness in which the maximum compression strain had been produced, i.e. in the direction of the maximum magnetic anisotropy.

Referring now to rolling, a billet for rolling was prepared by placing a total of 100 pieces of preforms 18 in 10 lines widthwise and in 10 rows lengthwise, covering their whole surfaces with mild iron plates having a thickness of 10 mm and welding them together to enclose the preforms completely. The billet as described was employed to prevent any temperature drop at the time of rolling and any cracking of the free surfaces of products, while also realizing the simultaneous manufacture of a multiplicity of products. Each individual preform 18 had a thickness T of 36 mm, a width W of 19 mm and a length L of 25 mm. A 2000-ton reverse four-high mill was used to repeat 10 passes of rolling to obtain a permanent magnet thickness $T_1$ of 8 mm excluding the mild iron portion. The billet had an initial temperature of 800° C., while the rolls were at the room temperature. The resulting 100 pieces of permanent magnets 20 showed different magnetic properties depending on their widthwise or lengthwise position and the best magnetic properties were of the permanent magnet 20 situated in the vicinity of the center widthwise and at the front end of the first pass lengthwise. The permanent magnet 20 in that position was examined for the magnetic properties. More specifically, a magnetic test specimen having a width of 8 mm, a length of 8 mm and a thickness of 8 mm was taken from the widthwise and lengthwise central portion of the permanent magnet 20, magnetized in a magnetic field of 3.2 MA/m and examined for the magnetic properties by a BH tracer. The magnetic properties shown in Table 1 for the product of rolling are also those which were determined in the direction of the thickness, i.e. in the direction of the maximum magnetic anisotropy.

Forward extrusion is a method commonly employed in the art of extrusion and usually featured by the same degree of size reduction both in the X- and Y-directions. A permanent magnet 20 having a thickness $T_1$ of 8 mm, a width $W_1$ of 8 mm and a length $L_1$ of 506 mm was formed from a preform 18 having a thickness T of 36 mm, a width W of 36 mm and a length L of 25 mm. Details of the die except the dimensions thereof and the extrusion conditions were same as those employed in Experiment 1. A magnetic test specimen having a width of 8 mm, a length of 8 mm and a thickness of 8 mm was taken from the lengthwise central portion of the permanent magnet 20, magnetized in a magnetic field of 3.2 MA/m and examined for the magnetic properties by a BH tracer. The magnetic properties shown in Table 1 for the product of forward extrusion are those which were equally determined in the directions of the thickness and width in which the same maximum compression strain had been produced, i.e. in the direction of the maximum magnetic anisotropy.

TABLE 1

| | Strain ratio $\epsilon_2/\epsilon_1$ | Br (T) | iHc (MA/m) | (BH)max (KJ/m$^3$) |
|---|---|---|---|---|
| Comparative Example 1 | 0.1 | 1.08 | 1.28 | 235 |
| Example 1 | 0.2 | 1.14 | 1.22 | 260 |
| Example 2 | 0.4 | 1.35 | 1.21 | 360 |
| Example 3 | 0.8 | 1.41 | 1.22 | 392 |
| Example 4 | 1.0 | 1.47 | 1.22 | 428 |
| Example 5 | 1.6 | 1.44 | 1.20 | 401 |
| Example 6 | 2.0 | 1.20 | 1.23 | 285 |
| Example 7 | 3.5 | 1.15 | 1.25 | 264 |
| Comparative Example 2 | 4.0 | 1.12 | 1.28 | 250 |
| Product of upsetting | — | 1.36 | 0.96 | 340 |
| Product of rolling | — | 1.15 | 1.02 | 250 |
| Product of forward extrusion | — | 0.92 | 0.86 | 150 |
| Example 8 | 1.0 | 1.36 | 1.85 | 372 |
| Example 9 | 1.0 | 1.46 | 1.21 | 422 |
| Example 10 | 1.0 | 1.43 | 1.22 | 406 |

TABLE 2

| | Preform 18 | | | Permanent magnet 20 | | | |
|---|---|---|---|---|---|---|---|
| | Thickness T (mm) | Width W (mm) | Length L(mm) | Thickness $T_1$ (mm) | Width $W_1$ (mm) | Length $L_1$ (mm) | $\epsilon_2/\epsilon_1$ |
| Comparative Example 1 | 36 | 19 | 25 | 8 | 21.8 | 98.1 | 0.1 |
| Example 1 | 36 | 19 | 25 | 8 | 24.4 | 87.5 | 0.2 |
| Example 2 | 36 | 19 | 25 | 8 | 29.2 | 73.2 | 0.4 |
| Example 3 | 36 | 19 | 25 | 8 | 37 | 57.8 | 0.8 |
| Example 4 | 36 | 19 | 25 | 8 | 40 | 53.4 | 1.0 |
| Example 5 | 36 | 19 | 25 | 8 | 48 | 44.5 | 1.6 |
| Example 6 | 36 | 19 | 25 | 8 | 52 | 41.1 | 2.0 |
| Example 7 | 36 | 19 | 25 | 8 | 61.2 | 34.9 | 3.5 |
| Comparative Example 2 | 36 | 19 | 25 | 8 | 63.3 | 33.8 | 4.0 |
| Example 8 | 36 | 19 | 25 | 8 | 40 | 53.4 | 1.0 |

EXPERIMENT 2

A preform 18 having the same dimensions as in Experiment 1 was produced under the same conditions as in Experiment 1 by employing a magnetic alloy containing 26.8% by mass of Nd, 0.1% by mass of Pr, 3.6% by mass of Dy, 6% by mass of Co, 0.89% by mass of B and 0.57% by mass of Ga, with the balance of being substantially Fe. In Table 1, Example 8 of the invention shows the magnetic properties of a permanent magnet 20 which was produced by extruding the thus obtained preform 18 to have a thickness $T_1$ of 8 mm as extruded and a strain ratio $\epsilon_2/\epsilon_1$ of 1.0 as those of Example 4. Table 2 shows the dimensions of the preform 18 and the permanent magnet 20 according to Example 8. The conditions for extrusion and the specific method employed for determining magnetic properties were the same as those employed in Experiment 1.

Embodiment 2

Figure 9A:
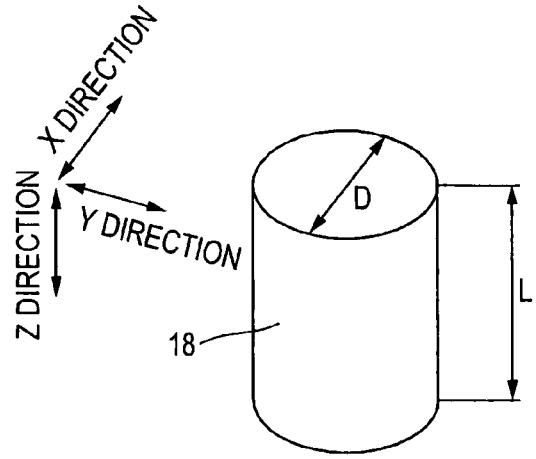
FIG. 9A is a schematic illustration of a preform according to Embodiment 2.
Figure 9B:
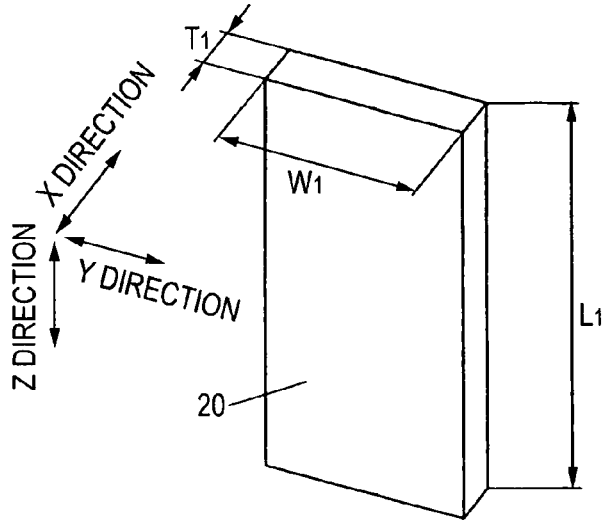
FIG. 9B is a schematic illustration of a permanent magnet formed from the preform shown in FIG. 9A.
Figure 10:
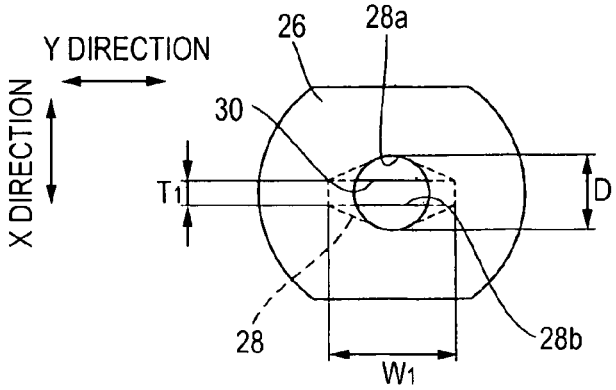
FIG. 10 is a top plan view of a forming die employed for producing a permanent magnet from the preform according to Embodiment 2.

While Embodiment 1 has been described as the case in which a plate-shaped permanent magnet 20 is produced from a preform 18 having an oblong cross section, it is also possible to produce a plate-shaped permanent magnet 20 from a solid cylindrical preform 18 as shown in FIGS. 9A and 9B. Results similar to those of Embodiment 1 can be obtained by controlling the dimensions of e.g. a through hole 12, a tapered hole 28 and a uniformly sized through hole 30 so as to realize a strain ratio $\epsilon_1/\epsilon_1=\ln(W_1/D)/\ln(L_1/L)$ in the range of from 0.2 to 3.5, preferably from 0.4 to 1.6 when a plate-shaped permanent magnet 20 having a thickness $T_1$, a width $W_1$ and a length $L_1$ is produced from a solid cylindrical preform 18 having a diameter D (in the X- and Y-directions) and a length L (in the Z-direction). In a forming die 26 used for producing the permanent magnet 20 according to Embodiment 2, the tapered hole 28 is formed to have an inlet 28*a* in a circular shape having the same diameter as that of the preform 18, while the outlet 28*b* and the uniformly sized through hole 30 are rectangular and have a thickness $T_1$ in the X-direction and a width $W_1$ in the Y-direction which are equal to those of the permanent magnet 20, as shown in FIG. 10.

EXPERIMENT 3

A solid cylindrical preform 18 having a diameter D of 14.5 mm and a length L of 22.5 mm was produced under the same conditions as in Experiment 1 by employing a magnetic alloy of the same composition as that employed in Experiment 1. In Table 1, Example 9 of the invention shows the magnetic properties of a permanent magnet 20 which was produced by extruding the thus obtained solid cylindrical preform 18 to have a thickness $T_1$ of 3 mm as extruded and a strain ratio $\epsilon_2/\epsilon_1$ of 1.0. Table 3 shows the dimensions of the preform 18 and the permanent magnet 20 according to Example 9. A magnetic test specimen having a width of 8 mm, a length of 8 mm and a thickness of 3 mm was taken from the widthwise and lengthwise central portion of the permanent magnet 20 according to Example 9 of the invention, magnetized in a magnetic field of 3.2 MA/m and examined for the magnetic properties by a BH tracer.

TABLE 3

| | Preform 18 | | Permanent magnet 20 | | | |
|---|---|---|---|---|---|---|
| | Diameter D (mm) | Length L (mm) | Thickness $T_1$ (mm) | Width $W_1$ (mm) | Length $L_1$ (mm) | $\epsilon_2/\epsilon_1$ |
| Example 9 | 14.5 | 22.5 | 3 | 28.3 | 43.8 | 1.0 |

Embodiment 3

Figure 11A:
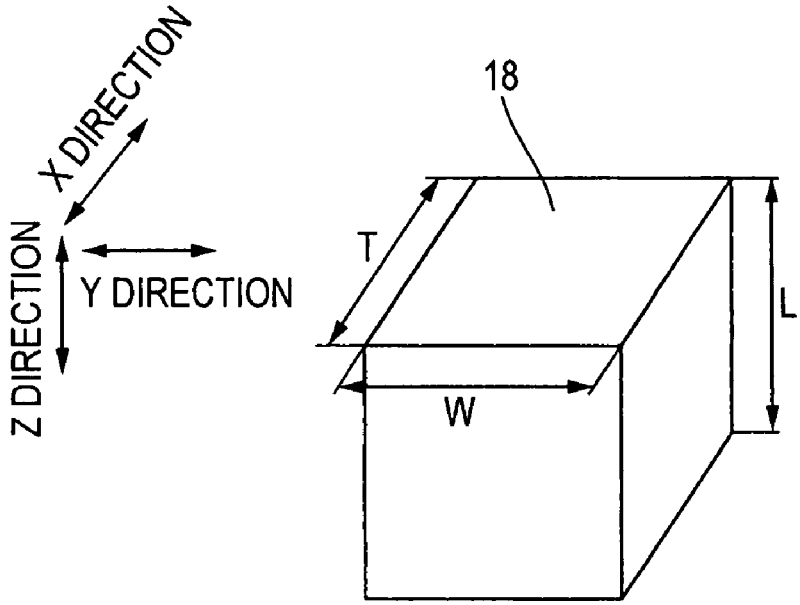
FIG. 11A is a schematic illustration of a preform according to Embodiment 3.
Figure 11B:
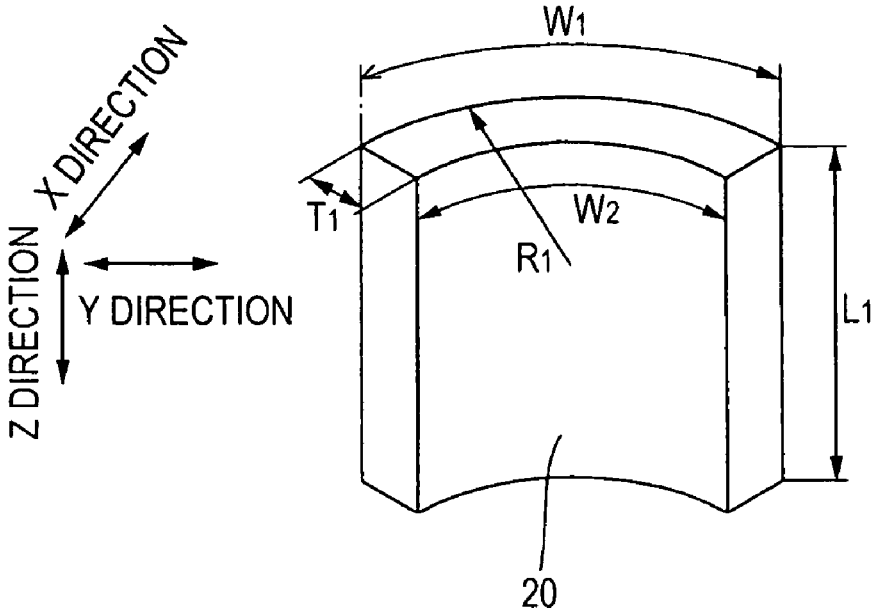
FIG. 11B is a schematic illustration of a permanent magnet formed from the preform shown in FIG. 11A.

According to Embodiment 3, a permanent magnet 20 having an arcuate cross section with a thickness $T_1$ in the X-direction, an outer arc length $W_1$ in the Y-direction and an inner arc length $W_2$ in the Y-direction is formed by extruding a preform 18 having an oblong cross section with a thickness T in the X-direction, a width W in the Y-direction and a length L in the Z-direction, as shown in FIGS. 11A and 11B. Results similar to those in Embodiment 1 can be obtained by controlling the dimensions of e.g. the through hole 12, tapered hole 14 and uniformly sized through hole 16 so as to realize a strain ratio $\epsilon_2/\epsilon_1=\ln(((W_1+W_2)/2)/W)/\ln(L_1/L)$ in the range of from 0.2 to 3.5, preferably from 0.4 to 1.6 when the magnet is extruded. The magnet according to Embodiment 3 has magnetic anisotropy oriented in the radial direction normal to the arcuate surface.

EXPERIMENT 4

A preform 18 having a rectangular cross section with a thickness T of 24 mm, a width W of 23 mm and a length L of 25 mm was produced under the same conditions as in Experiment 1 by employing a magnetic alloy of the same composition as that employed in Experiment 1. In Table 1, Example 10 of the invention shows the magnetic properties of a permanent magnet 20 which was produced by extruding the thus obtained preform to have an arcuate cross section with a thickness $T_1$ of 8 mm, an arc length $((W_1+W_2)/2)$ of 40 mm and an arc radius $R_1$ of 40 mm and a strain ratio $\epsilon_2/\epsilon_1$ of 1.0. Table 4 shows the dimensions of the preform 18 and the permanent magnet 20 according to Example 10. A magnetic test specimen having a width of 8 mm, a length of 8 mm and a thickness of 7 mm obtained by removing a thickness of about 0.5 mm from each of its opposite arcuate surfaces was taken from the widthwise and lengthwise central portion of the permanent magnet 20 according to Example 10 of the invention, magnetized in a magnetic field of 3.2 MA/m and examined for its magnetic properties by a BH tracer.

According to the experimental results shown in Table 1, it is confirmed that the magnetic properties can be improved by controlling a strain ratio $\epsilon_2/\epsilon_1$ in the range of $0.2\leqq\epsilon_2/\epsilon\leqq3.5$ and further improved by controlling a strain ratio $\epsilon_2/\epsilon_1$ in the range of $0.4\leqq\epsilon_2/\epsilon_1\leqq1.6$. It is also confirmed that the largest improvement in magnetic properties can be achieved by controlling a strain ratio $\epsilon_2/\epsilon_1$ approaching 1. The permanent magnets 20 according to Examples 1 to 10 of the invention were all good in appearance and none of them had any portion to be cut away, except a thickness of about 2 mm at each of the front and rear ends as viewed in the direction of its length. Furthermore, according to the penetrant and eddy-current flaw detection tests on each permanent magnet of the present invention, no surface or internal cracking was observed. Thus, it is confirmed that, according to the present invention, it is possible to produce a permanent magnet having high magnetic properties by extrusion which is excellent in terms of productivity, material yield, acceptable product ratio and manufacturing cost.

Modifications

The present invention is not restricted by the embodiments described above, and may be carried out in any other way as described below by way of examples.

Figure 12A:
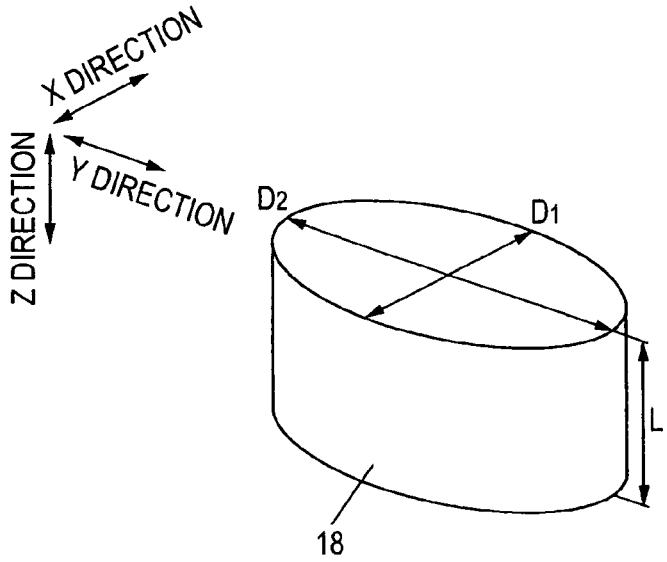
FIG. 12A is a schematic illustration of a preform according to a modified embodiment.
Figure 12B:
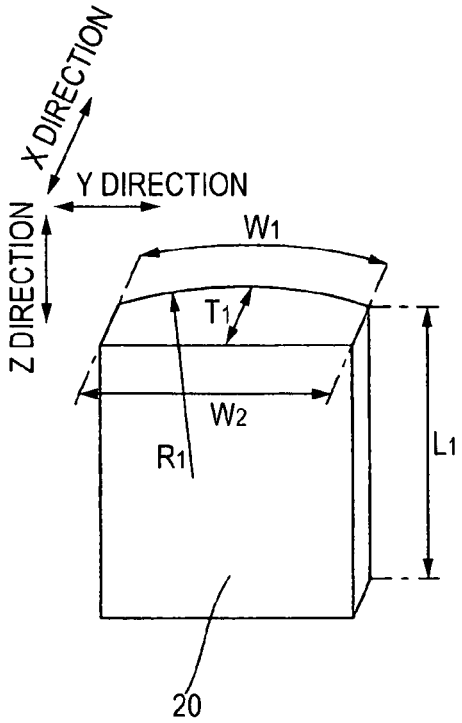
FIG. 12B is a schematic illustration of a permanent magnet formed from the preform shown in FIG. 12A.
Figure 12C:
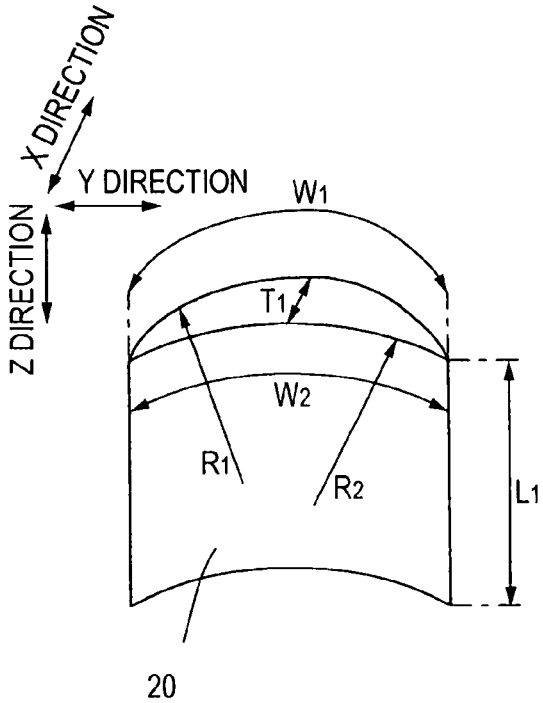
FIG. 12C is a schematic illustration of another permanent magnet formed from the preform shown in FIG. 12A.

1. A preform 18 having an oval cross section with a minor axis diameter $D_1$, a major axis diameter $D_2$ and a length L in the Z-direction as shown in FIG. 12A may be employed to produce a permanent magnet 20 having a semicylindrical or barrel-shaped cross section with a maximum thickness $T_1$ in the X-direction, an arcuate side width $W_1$ in the Y-direction, a straight side width $W_2$ in the Y-direction and a length $L_1$ in the Z-direction as shown in FIG. 12B, or a permanent magnet 20 having a crescent cross section with a maximum thickness $T_1$ in the X-direction, an outer arcuate side width $W_1$ in the Y-direction, an inner arcuate side width $W_2$ in the Y-direction and a length $L_1$ in the Z-direction as shown in FIG. 12C. Results similar to those in the Embodiments described above can be obtained by controlling the dimensions of e.g. the through hole 12, tapered hole 14 and uniformly sized through hole 16 so as to realize a strain ratio $\epsilon_2/\epsilon_1=\ln(((W_1+W_2)/2)/D_2)/\ln(L_1/L)$ in the range of from 0.2 to 3.5, preferably from 0.4 to 1.6. When a permanent magnet 20 having a semicircular or crescent cross section is formed from a preform 18 having an oval cross section, the X- and Y-directions depend on the thickness $T_1$ and widths (arc lengths) $W_1$ and $W_2$ of the permanent magnet 20. More specifically, there is a case that the minor axis diameter $D_1$ lies in the X-direction and the major axis diameter $D_2$ in the Y-direction, and there is the other case that the minor axis diameter $D_1$ lies in the Y-direction and the major axis diameter $D_2$ in the X-direction. This relationship also corresponds in the case that a preform having an oval cross section is formed into a magnet having a rectangular cross section, too. Some specific examples are shown in Table 5.

TABLE 4

| | Preform 18 | | | Permanent magnet 20 | | | | | |
|---|---|---|---|---|---|---|---|---|---|
| | Thickness T (mm) | Width W (mm) | Length L (mm) | Thickness $T_1$ (mm) | Arc length $W_1$ (mm) | Arc length $W_2$ (mm) | Length $L_1$ (mm) | Arc radius $R_1$ (mm) | $\epsilon_2/\epsilon_1$ |
| Example 10 | 24 | 23 | 25 | 8 | 44.4 | 35.6 | 43.1 | 40 | 0.1 |

TABLE 5

| | Preform 18 | | | Permanent magnet 20 | | | |
|---|---|---|---|---|---|---|---|
| | $D_1$ (mm) in X-direction | $D_2$ (mm) in Y-direction | Length L (mm) | Thickness $T_1$ (mm) | Width $W_1$ (mm) | Length $L_1$ (mm) | $\epsilon_2/\epsilon_1$ |
| True circle | 14.5 | 14.5 | 22.5 | 3 | 28.3 | 43.8 | 1.0 |
| Minor axis in X-direction | 14.5 | 16 | 22.5 | 3 | 31.2 | 43.8 | 1.0 |
| Major axis in X-direction | 14.5 | 13 | 22.5 | 3 | 25.4 | 43.8 | 1.0 |

2. The preform and permanent magnet may be of any other shape in cross section than those described above, or of any other cross-sectional combination than those described above.

3. Although the tapered hole of the forming die according to Embodiment 1 has been described as having at its entrance a portion having along a certain length a cross section equal to that of the through hole, it is also possible to form a tapered hole having its taper connected directly to the adjacent end of the through hole.

While the present invention has been described in detail and with reference to specific embodiments thereof, it will be apparent to one skilled in the art that various changes and modifications can be made therein without departing from the spirit and scope thereof.

The present application is based on Japanese Patent Application No. 2006-242146 filed on Sep. 6, 2006 and Japanese Patent Application No. 2007-176579 filed on Jul. 4, 2007, and the contents thereof are incorporated herein by reference.

Furthermore, all the documents cited herein are incorporated by reference in their entireties.

What is claimed is:

1. A process of producing a permanent magnet, which comprises extruding a preform to form a plate-shaped permanent magnet, wherein the preform is extruded in such a way that a dimension of a cross section of the preform is reduced in an X-direction and enlarged in a Y-direction perpendicular to the X-direction.

2. The process according to claim 1, whereby said permanent magnet has a strain ratio $\epsilon_2/\epsilon_1$ with respect to the preform in a range of 0.2 to 3.5, wherein $\epsilon_1$ is a strain in the direction of the extrusion of the preform and $\epsilon_2$ is a strain in the Y-direction.

3. The process according to claim 2, wherein said permanent magnet has a strain ratio in the range of 0.4 to 1.6.

4. A plate-shaped permanent magnet formed by extruding a preform, wherein the preform is extruded in such a way that a dimension of a cross section of the preform is reduced in an X-direction and enlarged in a Y-direction perpendicular to the X-direction, whereby said permanent magnet has a strain ratio $\epsilon_2/\epsilon_1$ with respect to the preform in a range of 0.2 to 3.5, wherein $\epsilon_1$ is a strain in the direction of the extrusion of the preform and $\epsilon_2$ is a strain in the Y-direction.

5. The plate-shaped permanent magnet according to claim 4, which has a strain ratio in the range of 0.4 to 1.6.

* * * * *